US007185371B2

(12) United States Patent
Koo

(10) Patent No.: US 7,185,371 B2
(45) Date of Patent: Mar. 6, 2007

(54) HAT

(76) Inventor: Dong Keun Koo, 33 Virginia Ave., Fort Lee, NJ (US) 07024

( * ) Notice: Subject to any disclaimer, the term of this patent is extended or adjusted under 35 U.S.C. 154(b) by 0 days.

(21) Appl. No.: 11/273,612

(22) Filed: Nov. 14, 2005

(65) Prior Publication Data

US 2006/0242751 A1 Nov. 2, 2006

Related U.S. Application Data

(60) Provisional application No. 60/627,816, filed on Nov. 13, 2004, provisional application No. 60/627,863, filed on Nov. 13, 2004.

(51) Int. Cl.
*A42B 1/24* (2006.01)

(52) U.S. Cl. ..... 2/209.13; 2/10

(58) Field of Classification Search ..... 2/10, 2/12, 15, 181, 183, 209.13
See application file for complete search history.

(56) References Cited

U.S. PATENT DOCUMENTS

| | | | |
|---|---|---|---|
| 542,636 | A | 7/1895 | Goldstein |
| 899,334 | A | 9/1908 | Seitzman |
| 1,097,530 | A | 5/1914 | Cabelinsky |
| 1,289,766 | A | 12/1918 | Hook |
| 1,696,198 | A | 12/1928 | Gross |
| 1,716,719 | A | 6/1929 | Christopher |
| 1,748,375 | A | 2/1930 | Wittcoff |
| 1,781,832 | A | 11/1930 | Crenshaw |
| 2,462,258 | A | 2/1949 | Dannenberg |
| 2,500,280 | A | 3/1950 | Feldman |
| 4,179,753 | A | 12/1979 | Aronberg et al. |
| 4,869,586 | A | 9/1989 | Chung |
| D306,512 | S | 3/1990 | Thomas et al. |
| 5,007,109 | A | 4/1991 | Wheeler |
| 5,177,810 | A | 1/1993 | Minton et al. |
| D349,389 | S | 8/1994 | Phillips |
| 5,473,778 | A | 12/1995 | Bell |
| 5,491,841 | A * | 2/1996 | Valletta ..... 2/10 |

(Continued)

FOREIGN PATENT DOCUMENTS

| | | |
|---|---|---|
| CH | 108478 | 3/1921 |

(Continued)

OTHER PUBLICATIONS

Cotton Baseball Cap with Transparent Lenses, Morphs mfg Ltd "http://www.tdcenterprise.com/cgi-bin/hkei.dll/Jsp/hkei/Template_ProductDetail.cmd?ProductOID =94713 &MemberID=754810", 2005.

(Continued)

*Primary Examiner*—Katherine Moran
(74) *Attorney, Agent, or Firm*—McCarter & English, LLP

(57) ABSTRACT

Disclosed is a hat with a shade panel that is constructed so as to achieve optimal optical efficiency. The shade panel is adapted to be attached to the crown of the hat via a flexible connecting member. The shade panel is moveable between a retracted position, in which the shade panel is positioned inside a cavity of the hat, and an extended position, in which the shade panel is positioned outside of the cavity of the hat, orienting the shade panel substantially vertically and in close proximity to a wearer's face.

9 Claims, 9 Drawing Sheets

U.S. PATENT DOCUMENTS

| | | | | | |
|---|---|---|---|---|---|
| 5,553,325 | A | | 9/1996 | Gutierrez | |
| 5,581,807 | A | * | 12/1996 | Peterson | 2/10 |
| 5,729,833 | A | | 3/1998 | Judge | |
| 5,815,832 | A | * | 10/1998 | Skolik | 2/10 |
| D403,490 | S | | 1/1999 | Posner | |
| 5,930,834 | A | * | 8/1999 | Toovey | 2/10 |
| D424,282 | S | | 5/2000 | Crumpton et al. | |
| 2003/0074708 | A1 | | 4/2003 | Hogg | |
| 2005/0132461 | A1 | | 6/2005 | Koo | |

FOREIGN PATENT DOCUMENTS

| | | |
|---|---|---|
| CH | 109881 | 5/1925 |
| CH | 139164 | 6/1930 |
| DE | 418658 | 9/1925 |
| DE | 461664 | 6/1928 |
| FR | 700.393 | 2/1931 |
| KR | 20-0199241 | 10/2000 |
| WO | WO 96/28986 A1 | 9/1996 |

OTHER PUBLICATIONS

Source code for Cotton Baseball Cap with Transparent Lenses from Morphs mfg Ltd on HKenterprises.com: "http://www.tdcenterprise.com/cgi-bin/hkei.dll/Jsp/hkei/Template_ProductDetail.cmd?ProductOID=94713&MemberID=754810", 10 Pages, 2002.

Source code for Cotton Baseball Cap with Transparent Lenses from Morphs mfg Ltd on HKenterprises.com Friendly Print window: "http://www.tdcenterprise.com/cgi-bin/hkei.dll/Jsp/hkei/Template_ProductDetail.cmd?ProductOID=94713&MemberID=754810", 18 Pages, Nov. 21, 2002.

* cited by examiner

HAT

CROSS-REFERENCE TO RELATED APPLICATIONS

This application claims priority to U.S. Provisional Patent Application Ser. No. 60/627,816 and to U.S. Provisional Patent Application Ser. No. 60/627,863, both of which were filed on Nov. 13, 2004, and the disclosures of both of which are incorporated herein by reference in their entirety. This application also relates to applicant's U.S. patent application Ser. No. 10/848,284 filed May 18, 2004 now abandoned, the disclosure of which is incorporated herein by reference in its entirety.

FIELD OF THE INVENTION

The present invention relates to a hat, and, more particularly, to a hat equipped with a shade panel.

BACKGROUND OF THE INVENTION

Hats having "fold-out", integrated shade panels have been developed in the past for protecting the wearers' eyes (see, for instance, U.S. Pat. Nos. 5,491,841, 5,581,807 and 5,930,834). In this type of hat, it is desirable to affix the shade panel such that it can be disposed close to the eyes of a wearer for achieving optimal optical efficiency. However, the shade panels of conventional hats tend to be positioned in a generally horizontal position, thereby compromising their ability to effectively perform their intended function.

SUMMARY OF THE INVENTION

The present invention overcomes the disadvantages and shortcomings of the prior art discussed above by providing a new and improved head covering (i.e., an article of headwear) for covering at least a portion of a wearer's head. The head covering includes a body having a crown which defines a cavity sized and shaped so as to receive at least a portion of a wearer's head. The head covering also includes a shade panel and a connecting member for attaching the shade panel to the body such that the shade panel can be folded at least partially into the cavity. More particularly, the shade panel is movable between a first position, in which the shade panel is positioned inside the cavity (e.g., when not in use), and a second position, in which the shade panel is positioned outside of the cavity (e.g., when in use to shade the wearer's eyes from the sun). The connecting member is provided with a crescent formation with its opposing lateral ends being tapered so as to be narrower than its center for orienting the shade panel generally vertically when the shade panel is in its second position.

BRIEF DESCRIPTION OF THE DRAWINGS

The above and other objects, features and advantages of the present invention will be apparent from the following detailed description of the invention in conjunction with the accompanying drawings, in which.

DETAILED DESCRIPTION OF THE INVENTION

Figure 1:
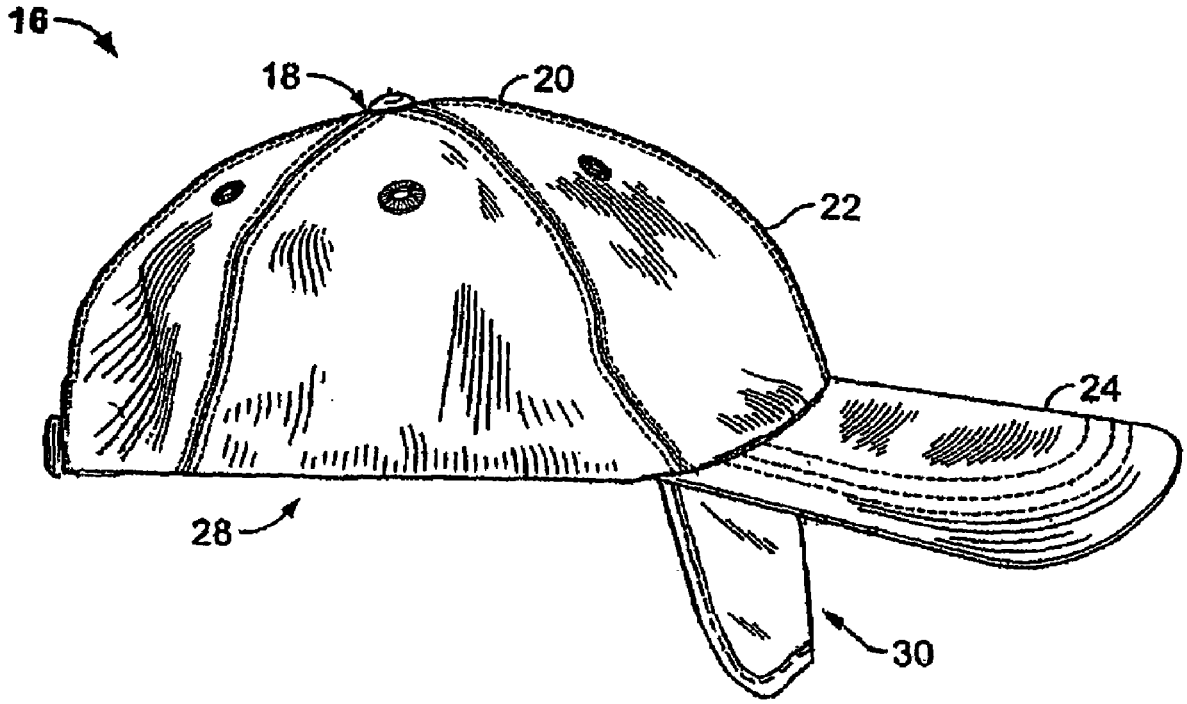
FIG. 1 is a side elevational view of a hat having a shade panel constructed in accordance with the present invention, illustrating the shade panel in its extended position.

Referring to FIGS. 1–10, a hat 16 has a body 18 which includes a crown 20 having a front face 22 and a visor 24 extending from the front face 22. A sweatband (i.e., a headband) 26 lines the inner peripheral surface of the crown 20, which defines a cavity 28 for receiving at least a portion of a wearer's head. More particularly, the sweatband 26 is attached to the crown 20 via a stitching 21, a portion of which extends along the interface between the crown 20 and the visor 24 (see FIG. 3).

Referring primarily to FIGS. 2, 4, 5, 9 and 10, the hat 16 also includes a shade panel 30 which is preferably attached to the crown 20 along the interface between the crown 20 and the visor 24 and which is configured so as to cover the wearer's eyes. The shade panel 30 comprises a shade member 32 and a binding or lining 34 that covers the outer edge or edges of the shade member 32. The binding 34 may be made of fabric folded over and secured to the outer edges of the shade member 32. The surface area of the shade member 32 affords protection of the wearer's eyes and may also extend coverage to the proximate facial region.

Figure 2:
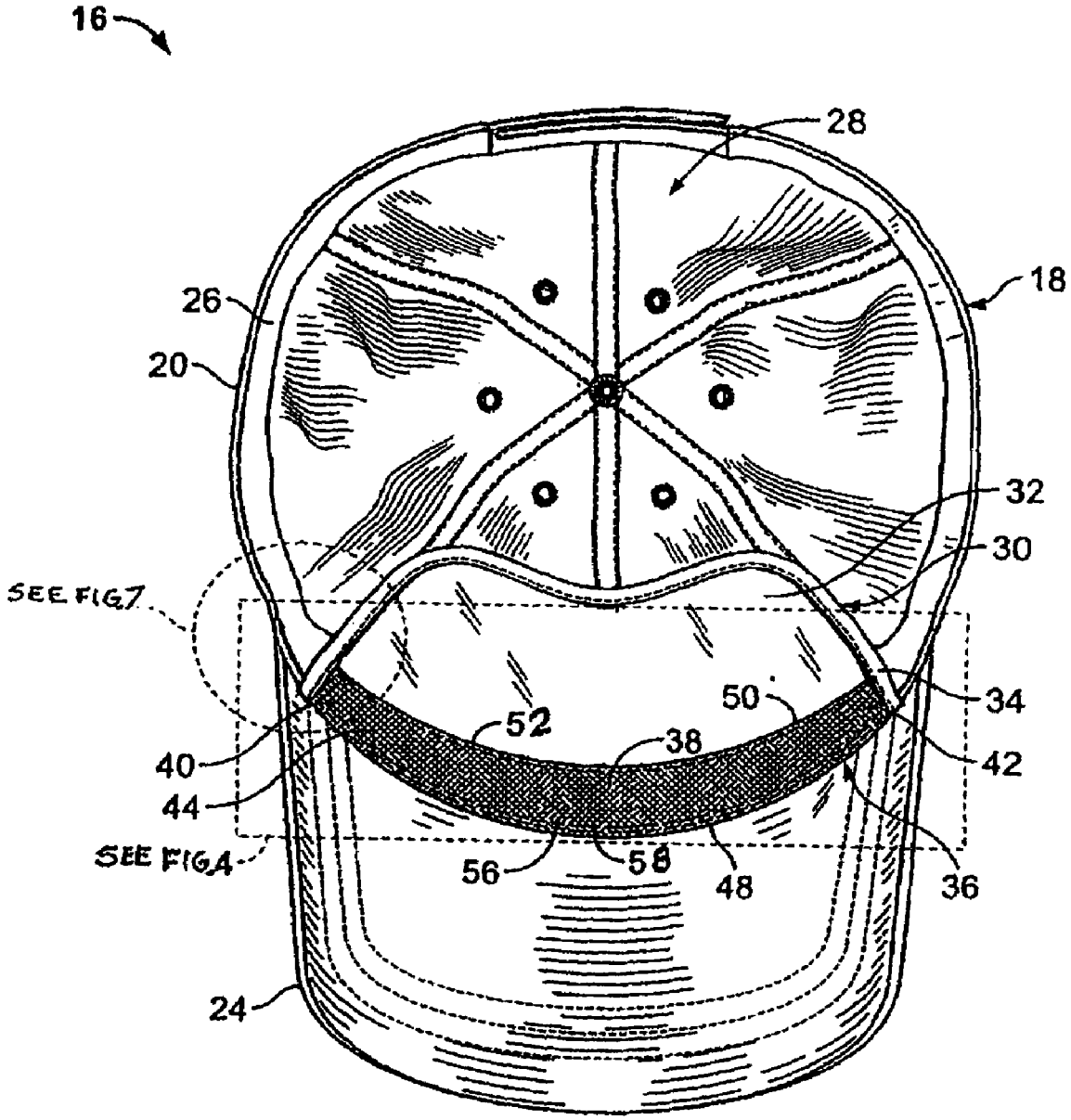
FIG. 2 is a bottom plan view of the hat shown in FIG. 1 with the shade panel folded into the hat.
Figure 5:
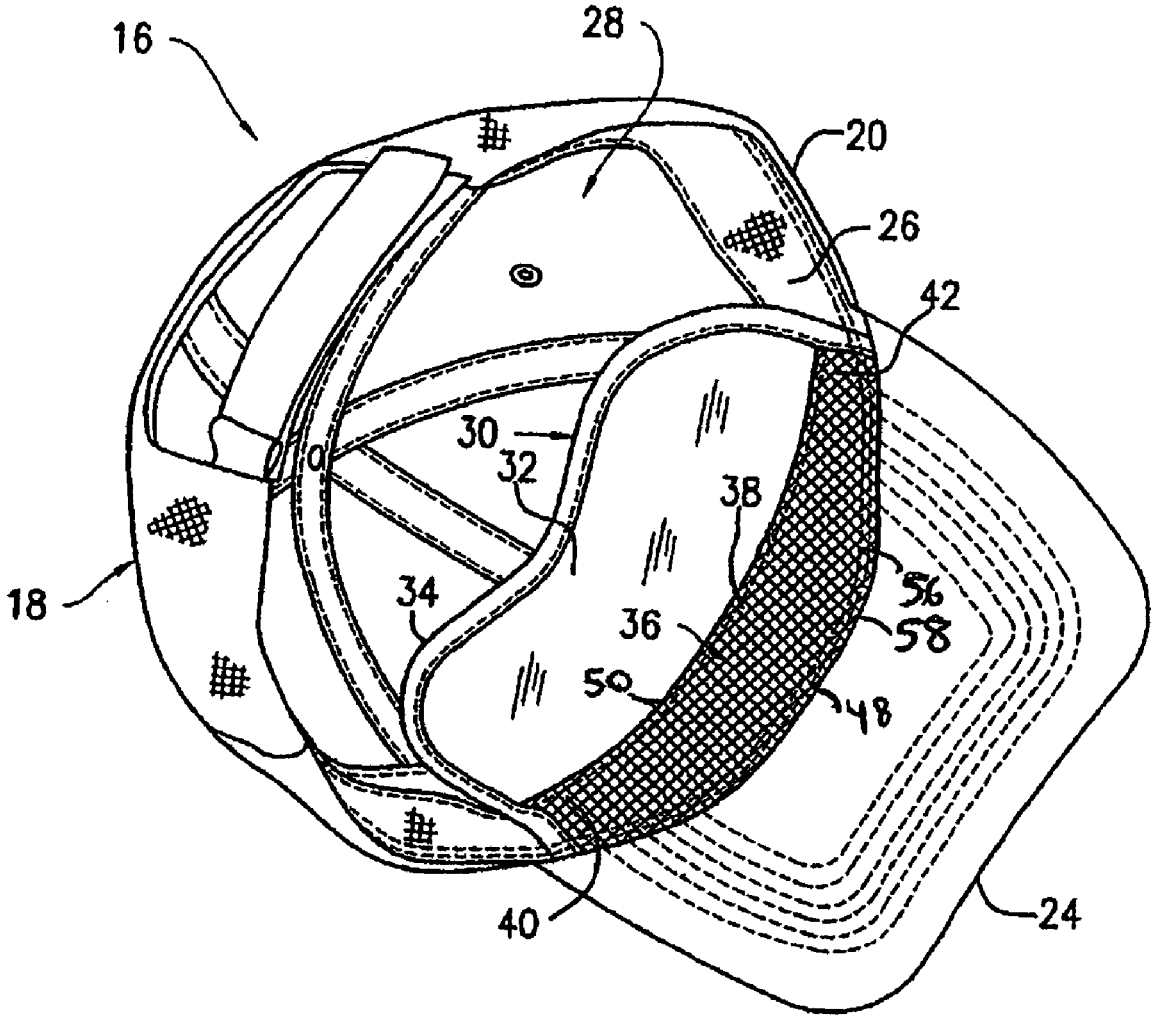
FIG. 5 is a bottom perspective view of the hat shown in FIG. 1, looking generally from the rear, with the shade panel folded into the hat.
Figure 6:
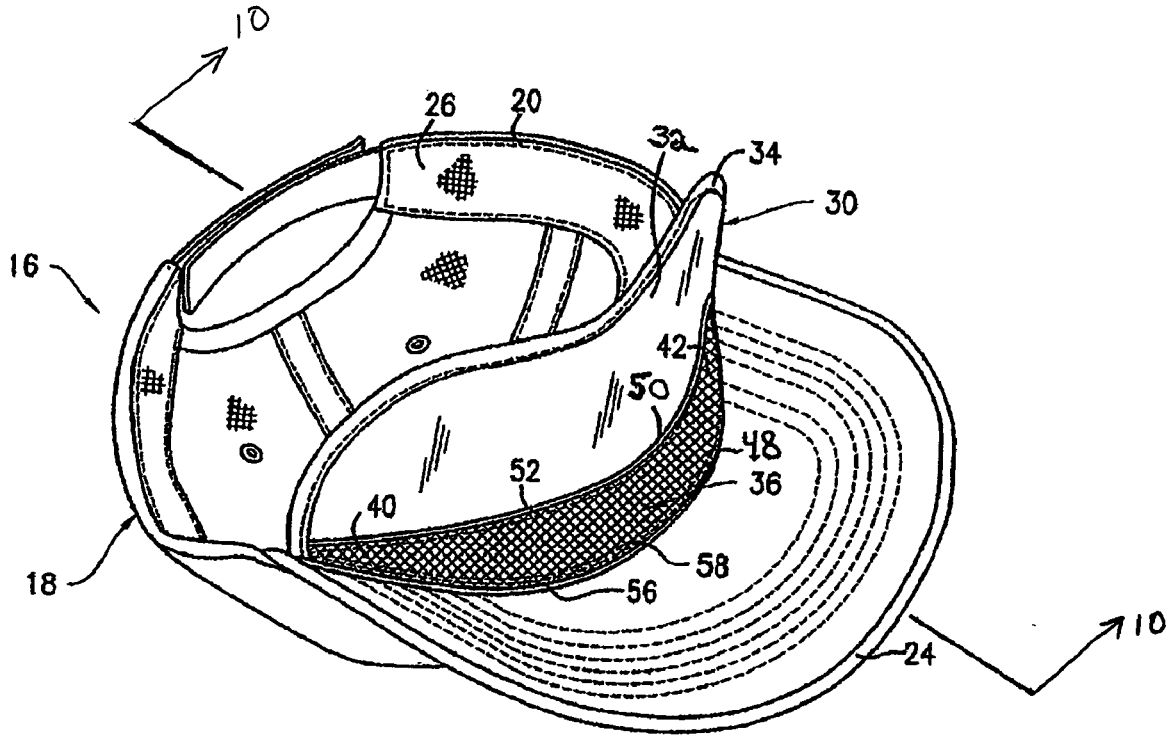
FIG. 6 is a bottom perspective view of the hat shown in FIG. 1, looking generally from the front.

The shade member 32 is preferably constructed as a sheet made from flexible, resilient plastic material which is made in a conventional manner (e.g., a polycarbonate film) so that the shade member 32 can be positioned so as to be disposed inside of the cavity 28 of the crown 20, as shown in FIGS. 2 and 5. Such a material can preferably have color tinting to filter sunlight and protect the wearer's eyes and/or be provided with an additive that enables same to filter out harmful ultraviolet (UV) radiation in accordance with conventional industry practice.

Referring to FIGS. 2–10, the hat 16 includes a connecting member 36 having opposed ends 40, 42, a center 38 substantially equidistant from the ends 40, 42, front and back surfaces 44, 46, a top 48 and a bottom 50. The connecting member 36 is made of a generally flexible material, preferably fabric (shown as having a cross-hatched pattern in the accompanying drawings), to allow folding of the shade panel 30 into and out of the cavity 28 of the hat 16. More particularly, the shade panel 30 is movable between a retracted, stowed position, in which it is positioned inside the cavity 28 as shown in FIGS. 2 and 5 (e.g., when not in use), and an extended, deployed position, in which it is positioned outside of the cavity 28 as shown in FIGS. 1, 4, 6 and 10 (e.g., when in use to shade the wearer's eyes from the sun). Due to the flexibility and resilience of the shade panel 30, it is adapted to be "popped" into its retracted or extended position and maintained therein without the use of a separate retaining mechanism.

Figure 7:
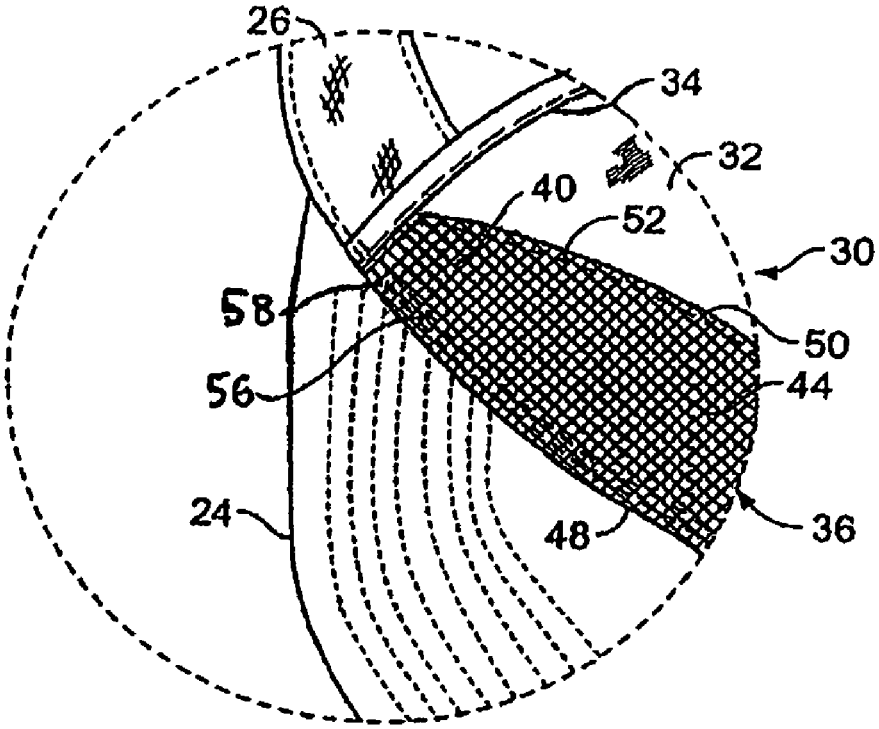
FIG. 7 is an enlarged view of a portion of the hat shown in FIG. 2.
Figure 8:
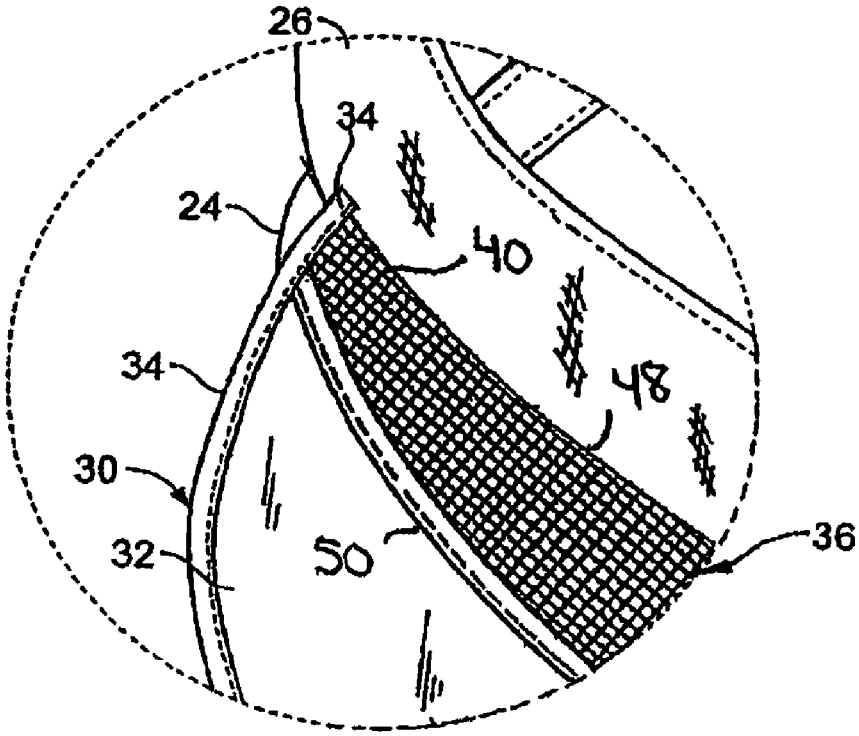
FIG. 8 is an enlarged view of a portion the hat shown in FIG. 4.

With reference to FIGS. 2–6, the connecting member 36 has a generally crescent formation. In other words, the connecting member 36 is formed such that it is widest at or adjacent its center 38 and tapers at its ends 40, 42 so that the ends 40, 42 are narrower than the center 38. FIG. 7 is a detailed view of the tapered end 40 of the connecting member 36 with the shade panel 30 in its retracted position, and FIG. 8 is a detailed view of the tapered end 40 with the shade panel 30 positioned in its extended position.

Figure 9:
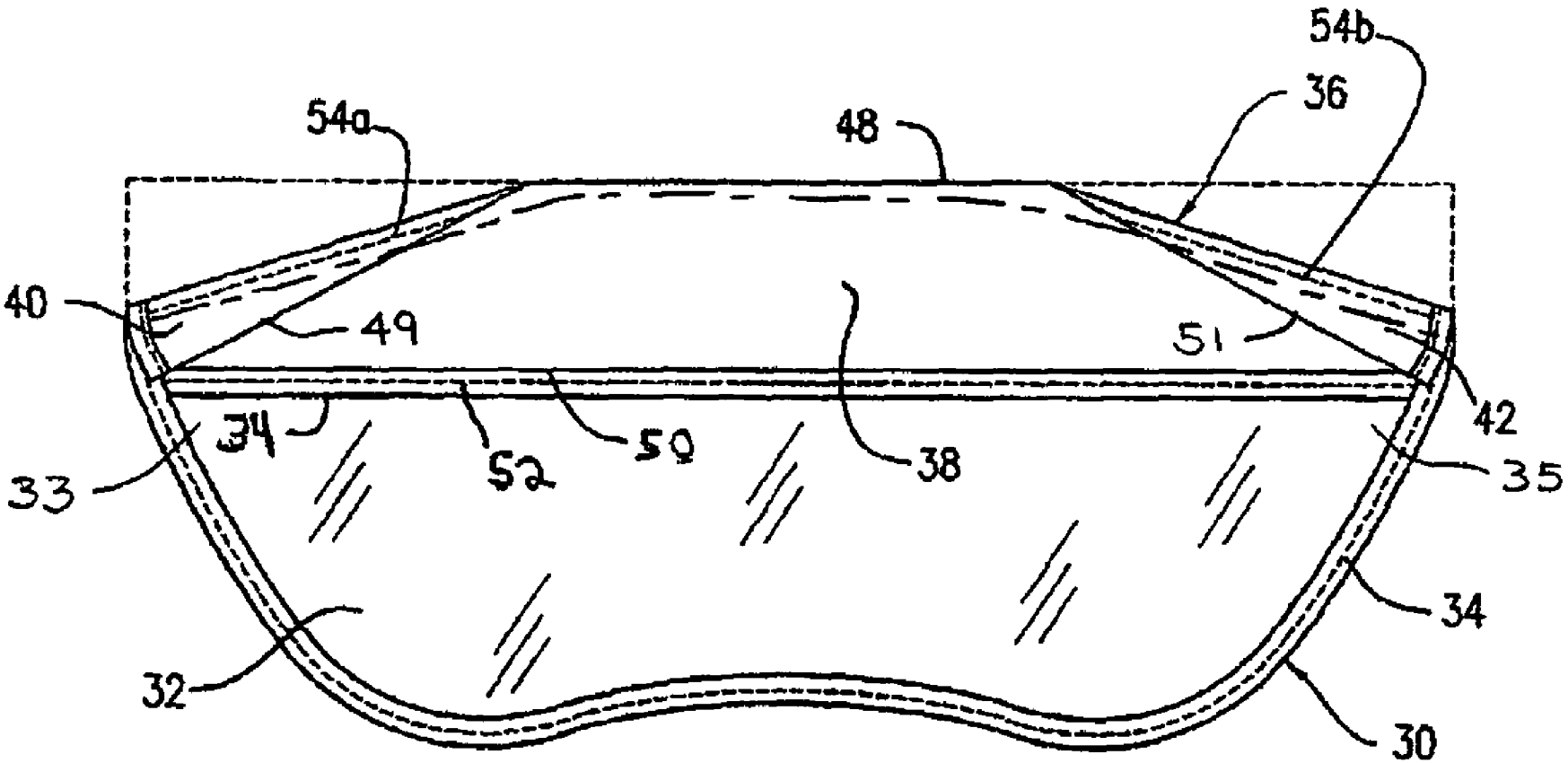
FIG. 9 is a plan view of the shade panel and its associated connecting member of the hat shown in FIG. 1.
Figure 10:
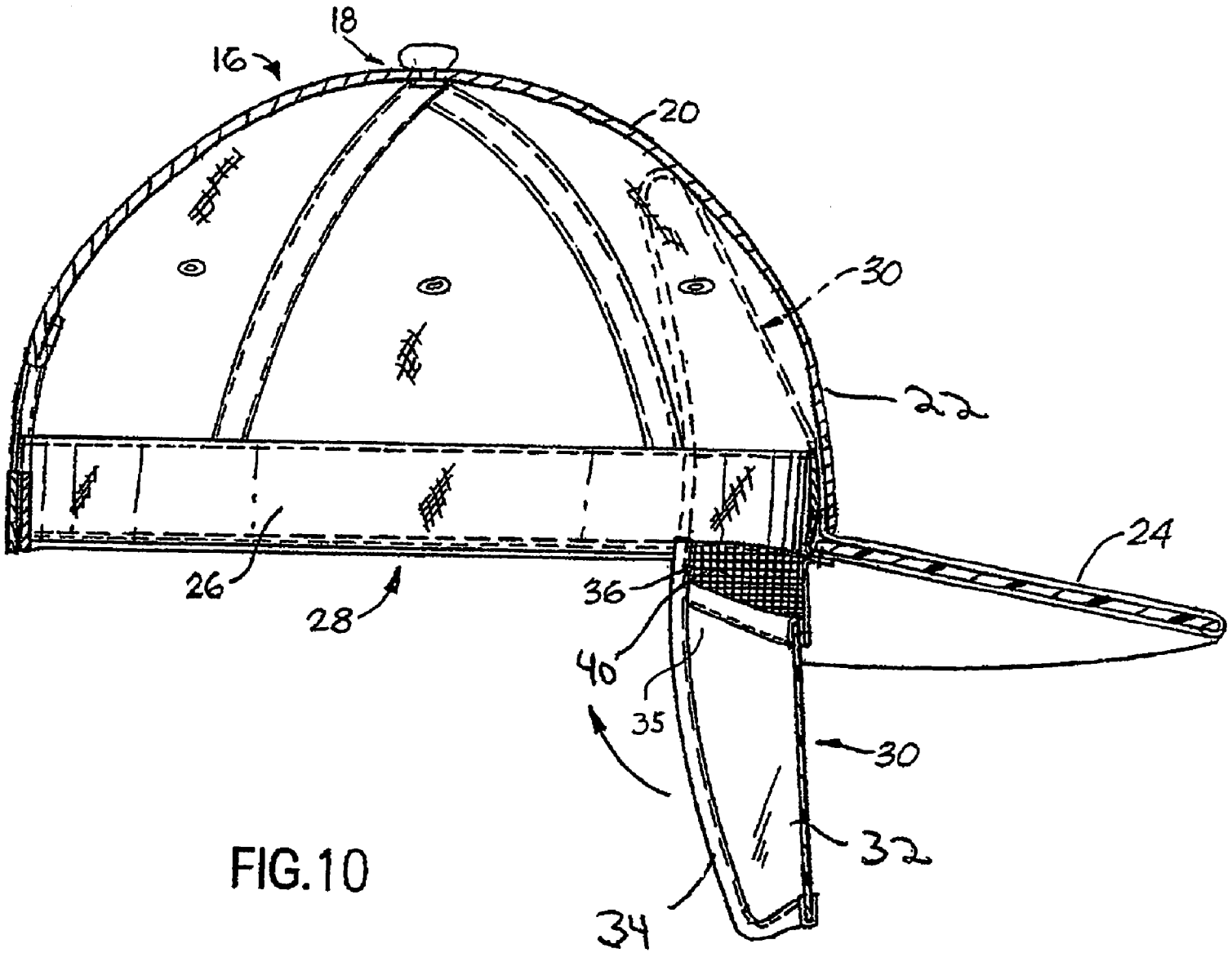
FIG. 10 is a cross-sectional view, taken along section line 10—10 and looking in the direction of the arrows, of the hat shown in FIG. 6.

Now referring to FIG. 10, the connecting member 36 is adapted to orient the shade panel 30 in a substantially vertical orientation when the shade panel 30 is positioned in its extended position. More particularly, due to its crescent formation, the tapered ends 40, 42 of the connecting member 36 function to pull their corresponding opposing upper edges 33, 35 (see FIGS. 9 and 10) of the shade panel 30 closer to the crown 20. As a result, the shade panel 30 can be positioned in close proximity to the wearer's face so as to provide optimal optical efficiency.

Referring to FIG. 9, the connecting member 36 is made by forming a generally rectangular elongated piece of fabric (with its upper corners 49, 51 shown in phantom) and then attaching same to the binding 34 of the shade panel 30. More particularly, the ends 40, 42 and the bottom 50 of the connecting member 36 are inserted into a U-shaped part of the binding 34 and are then secured therein by a stitching 52. Next, the upper corner portions 49, 51 of the connecting member 36 are folded over upon the rest of the connecting member 36 at an angle so as to taper the ends 40, 42, thereby giving the connecting member 36 a generally trapezoidal shape. The folded-over corner portions 49, 51 are then sewn along their upper edges via stitchings 54*a*, 54*b*, respectively, so as to secure the ends 40, 42, respectively, in their tapered formation. More particularly, the stitchings 54*a*, 54*b* are formed such that they are sloped downwardly towards the ends 40, 42, respectively. As a result, the stitchings 54*a*, 54*b* proximate the center 38 are farthest from the stitching 52 (i.e., the shade member 32). However, as the stitchings 54*a*, 54*b* approach the ends 40, 42 of the connecting member 36, they converge toward the stitching 52. After the stitchings 54*a*, 54*b* are applied, loose excess pieces of the folded-over corner portions 49, 51 are cut off.

Figure 3:
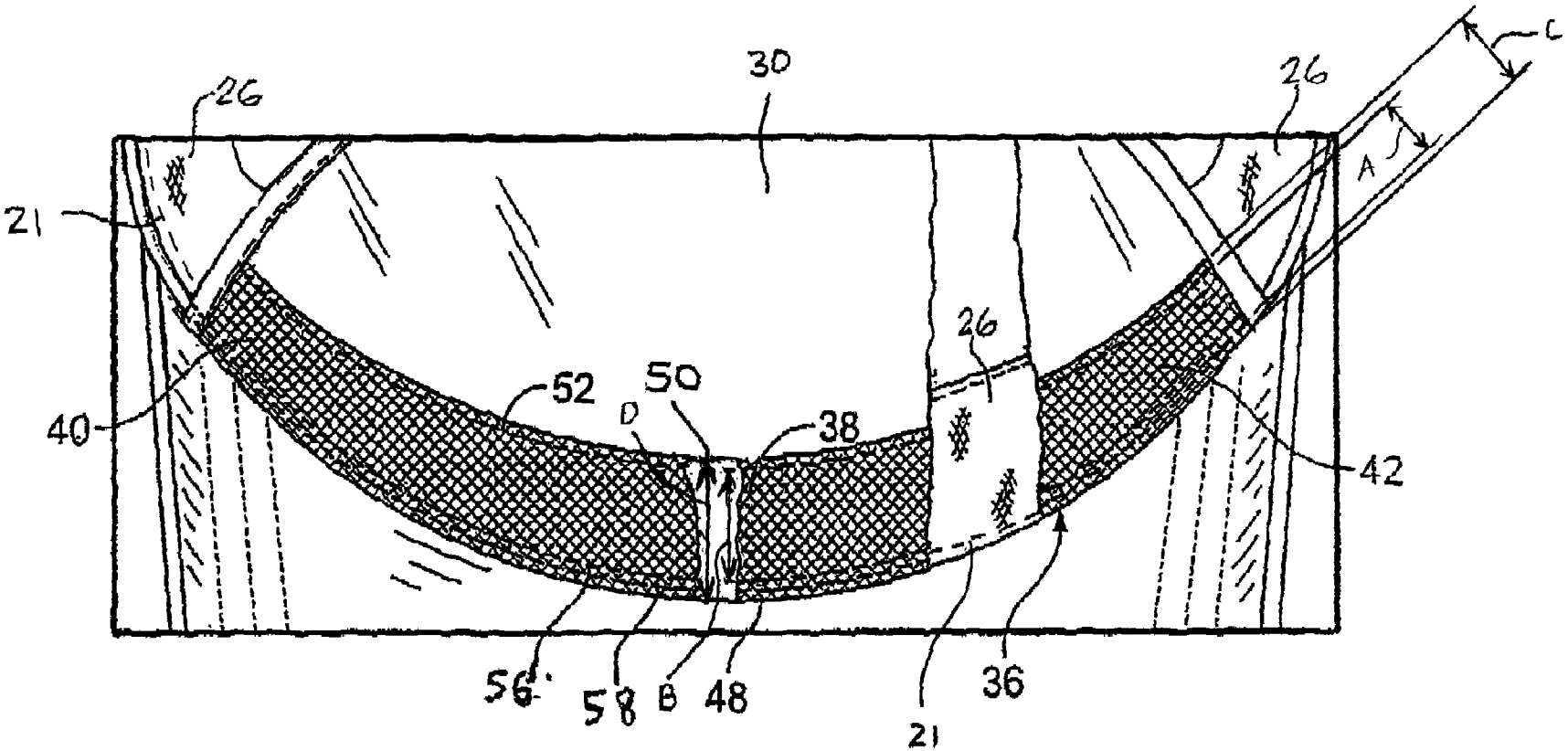
FIG. 3 is an enlarged, partially broken-away view of a portion of the hat shown in FIG. 2.
Figure 4:
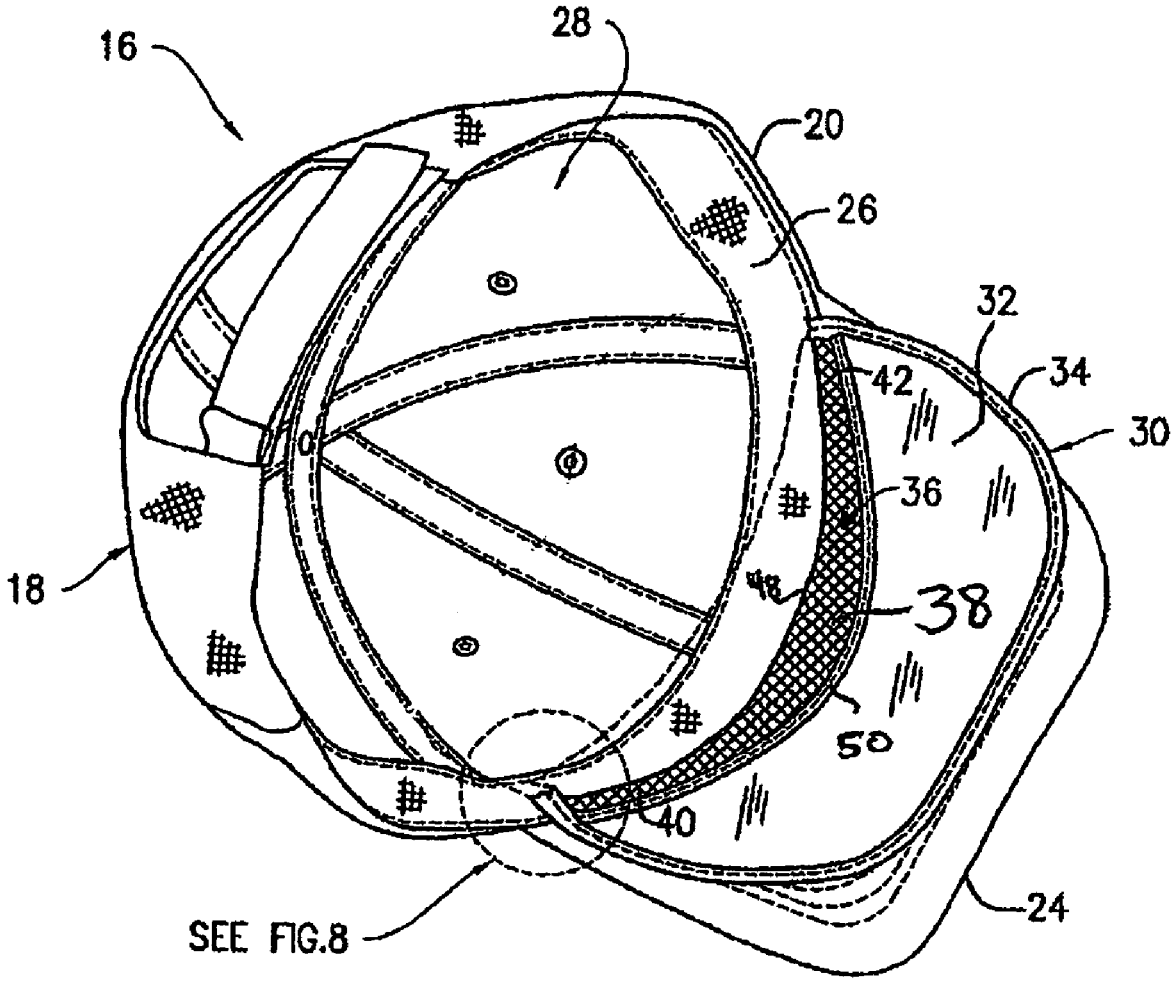
FIG. 4 is a bottom perspective view of the hat shown in FIG. 1, looking generally from the rear, with the shade panel in its extended position.

With reference to FIGS. 2, 3 and 5, once the folded-over corner portions 49, 51 have been stitched and the loose excess pieces have been cut off, the assembled connecting member 36 and shade panel 30 are positioned relative to the hat 16 such that the shade panel 30 is positioned generally inside the cavity 28 and the connecting member 36 is laid over the sweatband 26 adjacent the visor 24 (the side of the connecting member 36 having the corner portions 49, 51 folded thereonto facing the sweatband 26). The connecting member 36 is then sewn to the crown 20 along its upper edge (i.e., the upper edges of the folded-over corner portions 49, 51 and the top 48) via a stitching 56 (see the alternating long and short lines in FIG. 9). More particularly, the stitching 56 extends between the ends 40, 42 of the connecting member 36 in an arcuate path along the interface between the crown 20 and the visor 24 so as to attach the connecting member 36 to the crown 20 through the sweatband 26. Preferably, the stitching 56 is reinforced by a reinforcement stitching 58 which extends along the stitching 56. The stitchings 52, 54*a*, 54*b*, 56 and 58 each include multiple sequential stitches.

By tapering the ends 40, 42 and/or forming the stitching 56 along an arcuate path or stitching line, the connecting member 36 is provided with a crescent formation or shape so as to orient the shade panel 30 in a generally vertical orientation. While any suitable dimensions can be used for forming the crescent shape of the connecting member 36, it has been found that the following dimensions are particularly suitable for the proper orientation of the shade panel 30: a distance of about 0.5 cm for the width A (see FIG. 3) between the stitching 52 and the stitching 56 at the ends 40, 42 of the connecting member 36; and a distance of about 2.5 cm for the width B (see FIG. 3) between the stitching 52 and the stitching 56 at or adjacent the center 38 of the connecting member 36. The overall width C of the tapered ends 40, 42 of the connecting member 36 and the overall width D of the connecting member 36 at or adjacent its center 38 can preferably be about 1.0 cm and 3.5 cm, respectively.

The present invention provides numerous advantages over the prior art discussed above. For instance, due to the crescent formation of the connecting member 36, the shade panel 30 is adapted to assume a generally vertical orientation when positioned in its extended position. More particularly, the tapered ends 40, 42 draw the sides of the shade panel 30 closer to the crown 20 and hence to the wearer's face. The connecting member 36 and the shade panel 30 together define a structure that extends substantially vertically from the sweatband 26, similar to the face mask component of a welder's helmet. Accordingly, the vertical orientation of the shade panel 30 provides enhanced protection for the wearer's eyes and face from sunlight and improved optical efficiency compared to a shade panel having a predominantly horizontal orientation.

The hat 16 is also provided with improved durability for flipping the shade panel 30 between its extended and retracted positions. More particularly, because the stitchings 56 and 58 extend entirely between the ends 40, 42 of the connecting member 36, they function to distribute the force created by the flipping motion of the shade panel 30 along their entire length, thereby providing the connecting member 36 with enhanced durability. As a result, the hat 16 of the present invention tends to have a longer operational life.

The present invention also provides a hat 16 with a shade panel 30 that is convenient to use, is made at a substantially low cost, and is constructed in a simple but mechanically durable manner that facilitates proper orientation of the shade panel 30 relative to the wearer's eyes.

It will be understood that the embodiment described herein is merely exemplary and that a person skilled in the art may make variations and modifications without departing from the spirit and scope of the invention. For example, the shade panel 30 may include two separate ocular pieces corresponding to and dimensioned so as to shield a wearer's eyes individually. Moreover, the connecting member 36 can be attached to the visor 24 adjacent its interface with the crown 20. In addition, the sweatband 26 can be eliminated. Further, the folding of the upper corner portions 49, 51 can be eliminated. All such variations and modifications are included within the scope of the invention.

What is claimed is:

1. A hat comprising a body including a crown, said crown defining a cavity sized and shaped so as to receive at least a portion of a wearer's head; a shade panel; and a connecting member connecting said shade panel to said body such that said shade panel is movable between a retracted position, in which said shade panel is positioned inside said cavity, and an extended position, in which said shade panel is positioned outside of said cavity, said connecting member having first and second opposing ends and first and second opposing sides, said connecting member being attached to said body substantially continuously along a first path which extends along said first side between said first and second ends, said connecting member being attached to said shade panel substantially continuously along a second path which extends along said second path between said first and second ends, said first path being spaced from said second path adjacent said first end by a first distance, said first path being spaced from said second path adjacent a midpoint between said first and second ends by a second distance, and said first distance being smaller than said second distance.

2. The hat of claim 1, wherein said first path is spaced from said second path at said second end by a third distance, which is smaller than said second distance.

3. The hat of claim 2, wherein said connecting member is attached to said body substantially continuously along the entire portion of said first path; and said connecting member is attached to said shade panel substantially continuously along the entire portion of said second path.

4. The hat of claim 3, wherein said connecting member is stitched to said body substantially continuously along the entire portion of said first path; and said connecting member is stitched to said shade panel substantially continuously along the entire portion of said second path.

5. The hat of claim 4, wherein said first path is arcuate.

6. The hat of claim 5, wherein said first side is non-linear; and wherein said second side is substantially linear.

7. The hat of claim 6, wherein said shade panel is made of a flexible, resilient material such that it can be moved between said extended and retracted positions in a popping motion.

8. The hat of claim 7, wherein said shade panel is sized and shaped so as to cover at least a top part of a wearer's face.

9. The hat of claim 7, wherein said shade panel is sized and shaped so as to cover the eyes of a wearer.

* * * * *